US007766149B2

(12) United States Patent
Tiepelmann et al.

(10) Patent No.: US 7,766,149 B2
(45) Date of Patent: Aug. 3, 2010

(54) INSPECTION SYSTEM FOR ROLLED PRODUCTS OF A MILLING STATION

(75) Inventors: Bernd Tiepelmann, Hilchenbach (DE); Horst Oemkes, Oberhausen (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/544,605

(22) PCT Filed: Jan. 30, 2004

(86) PCT No.: PCT/EP2004/000833

§ 371 (c)(1),
(2), (4) Date: Jun. 13, 2006

(87) PCT Pub. No.: WO2004/069441

PCT Pub. Date: Aug. 19, 2004

(65) Prior Publication Data

US 2006/0236511 A1 Oct. 26, 2006

(30) Foreign Application Priority Data

Feb. 5, 2003 (DE) ..... 103 04 582

(51) Int. Cl.
*B21D 33/00* (2006.01)

(52) U.S. Cl. ..... 198/302; 198/833; 198/329; 198/813; 414/222.01; 414/222.11

(58) Field of Classification Search ..... 19/17.2; 198/302, 833, 329, 813; 451/513, 515; 414/592, 414/222.01, 222.11
See application file for complete search history.

(56) References Cited

U.S. PATENT DOCUMENTS 2,023,904 A * 12/1935 Schulte ..... 29/17.2
2,540,367 A 2/1951 Hamilton

FOREIGN PATENT DOCUMENTS

JP 07-120235 5/1995
NL 1 016 660 5/2002

* cited by examiner

*Primary Examiner*—Jessica L Ward
*Assistant Examiner*—Erin B Saad
(74) *Attorney, Agent, or Firm*—Lucas & Mercanti, LLP; Klaus P. Stoffel

(57) ABSTRACT

The aim of the invention is to create an inspection system (1) for rolled products (2) of a milling station, which is to reliably prevent the texture of the substrate from being impressed and/or pressing through during processing of the rolled product (2), especially during grinding. Said aim is achieved by disposing a number of vertically adjustable rolled product clamps (6, 8) on a conveyor belt (4) for rolled products (2) in the inspection system (1).

1 Claim, 2 Drawing Sheets

INSPECTION SYSTEM FOR ROLLED PRODUCTS OF A MILLING STATION

Figure 1A:
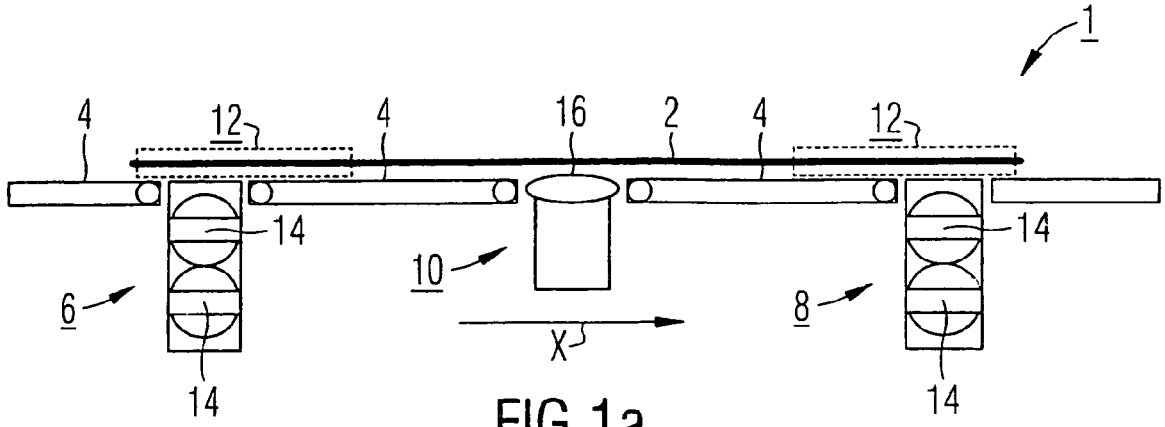

The invention concerns an inspection system for the rolled products of a rolling mill.

In order to subject the rolled products to an inspection for possible defects formed during the rolling operation, the surface of the rolled products is usually inspected by an inspector downstream of the rolling process. In this regard, a technique can be used in which the surface of a rolled product is ground, for example, by means of a stone, to make irregularities of the structure visible by this process. During this treatment of the rolled product, which, for example, is lying on a belt conveyor, the danger can exist that the texture of the support is impressed on the underside of the rolled product or even is pressed through the rolled product and thus becomes perceptible on the upper side. Defects that formed during the rolling process thus may not be satisfactorily detected and therefore may not be assigned to the correct source of the defect.

Therefore, the objective of the invention is to specify an inspection system of the aforementioned type for rolled products of a rolling mill which reliably prevents the texture of the support from being impressed and/or pressed through during the processing of the rolled product, especially during grinding.

In accordance with the invention, this objective is achieved by arranging a number of vertically adjustable clamps on a belt conveyor for rolled products in the inspection system.

The invention is based on the consideration that during the processing of the rolled product, especially during grinding, it is almost unavoidable that the texture of the support is impressed on or pressed through the rolled product to be tested by the application of pressure on the surface of the rolled product. In order to avoid potential difficulties for the inspector with respect to the detection of defects on a surface of the rolled product and their assignment to the rolling process or to the support, the inspection system was to be designed to disconnect the rolled product to be inspected from its support during grinding. This is made possible by a device that lifts the rolled product from the support. For this purpose, a number of vertically adjustable clamps for the rolled product are arranged on a belt conveyor for rolled products in the inspection system. These rolled product clamps make it possible to lock the rolled product in place, to bring it safely into a raised position above the belt conveyor for the grinding process, and to maintain this position during the processing.

It is advantageous for the rolled product to be in the clamped state for a careful, uniform grinding of the surface of the rolled product with respect to a subsequent reliable defect analysis. To place the rolled product in this processing position, it is advantageous to provide a vertically adjustable tensioning station between two clamps for the rolled product.

A specific embodiment of the invention is explained in greater detail below with reference to the drawings.

FIGS. 1 *a-f* show a schematic side view of an inspection system with different positions of the rolled product clamps and/or the tensioning station for rolled products.

Parts that are the same are labeled with the same reference numbers in all of the drawings.

The inspection system 1 for rolled products 2 of a rolling installation is used for inspection of the surfaces of a rolled product 2, such as sheet panels, for defects that may have been formed during the rolling process. During this operation, the rolled product 2 usually rests on a support, for example, a belt conveyor 4. Grinding of the surface or other types of pressure application may be useful in the inspection for the purpose of making even extremely fine surface roughness visible. During the grinding or other type of pressure application on the surface of the rolled product 2, which is supported on the belt conveyor 4, the direct contact with the belt conveyor 4 can cause the texture of the belt conveyor to be impressed on and/or pressed through the rolled product 2, and this can have at least a disturbing effect in the inspection for defects that arise from the rolling process.

For this reason, the inspection station 1 in the specific embodiment illustrated in FIGS. 1*a* to 1*f* includes two vertically adjustable clamps 6, 8 for the rolled product, which are arranged along the belt conveyor 4 in belt conveyor direction X. These clamps can lift the rolled product 2 from the belt conveyor 4 as required, so that the surface of the rolled product 2 has no contact with the belt conveyor during processing, since contact can interfere with reliable surface testing. The inspection system 1 also has a tensioning station 10 arranged between the two rolled product clamps 6, 8 to allow improved grinding of the rolled products 2.

The individual settings of the rolled product clamps 6, 8 and of the tensioning station 10 with respect to the belt conveyor 4 and the rolled product 2 that is to be ground are described below.

As FIG. 1*a* shows, in their initial position, the rolled product clamps 6, 8 and the tensioning station 10 are lowered to a level below the belt conveyor 4. In this initial position, a conventional inspection can be performed on the rolled product 2, which can then be fed to a device for further processing.

Figure 1B:
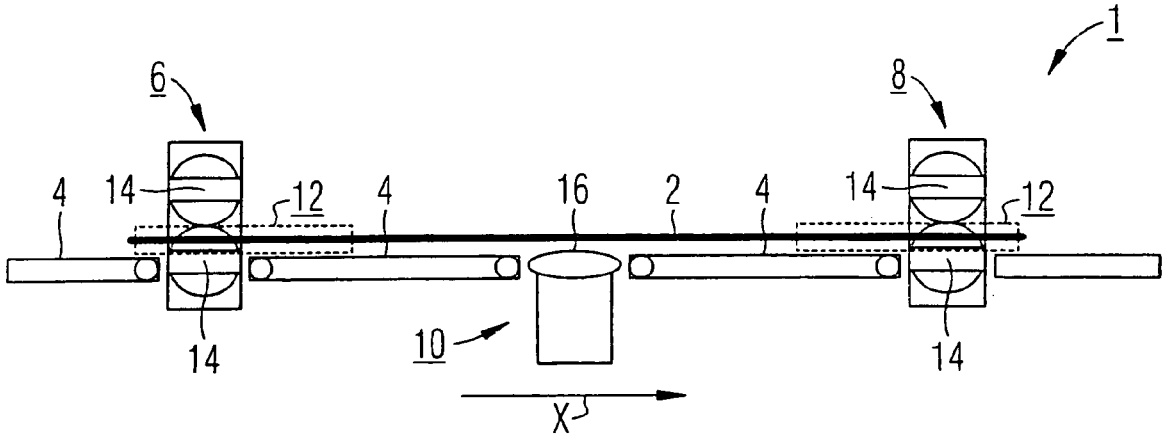
Figure 1C:
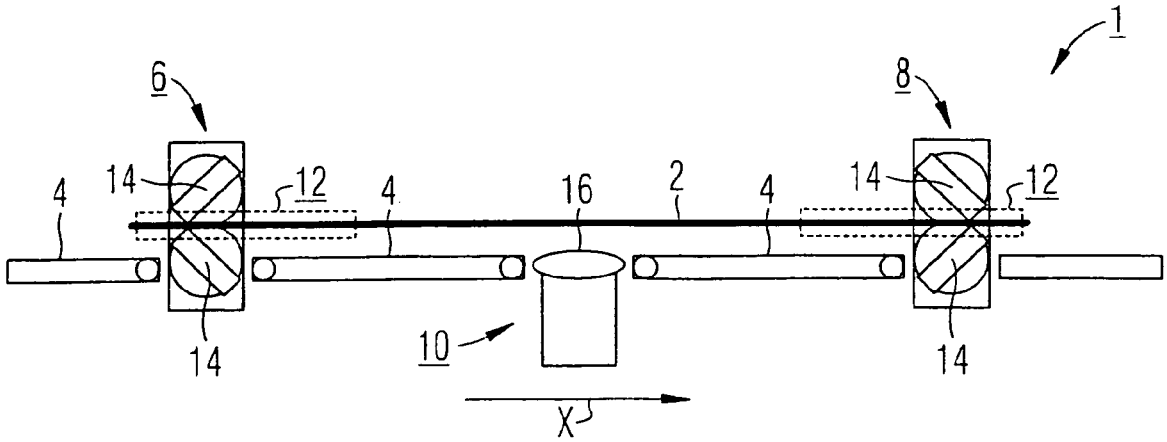

The drawings in FIGS. 1*b* and 1*c* show the rolled product clamps 6, 8 after they have been suitably raised to an intermediate position above the initial position. This intermediate position serves as a receiving position for the rolled product 2. In this raised intermediate position of the rolled product clamps 6, 8, the rolled product 2 to be ground is moved into the rolled product clamps 6, 8, and in this specific embodiment, the rolled product clamps 6, 8 tightly clamp the marginal areas 12 of the rolled product by means of so-called clamping jaws 14. FIG. 1*c* shows this tightly clamped state of the rolled product 2 with the clamping jaws 14 shown turned towards each other.

Figure 1D:
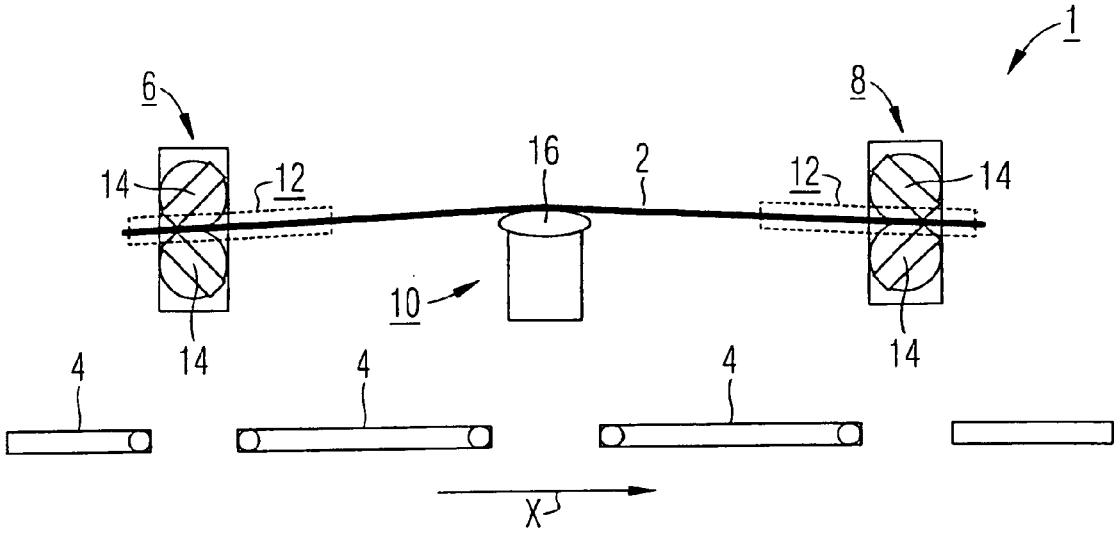

The drawing in FIG. 1*d* shows the inspection position of the rolled product clamps 6, 8 with the rolled product 2 tightly clamped in by means of the clamping jaws 14. In this position, the rolled product clamps 6, 8 are raised to an ergonomically favorable height, e.g., table height. The tensioning station 10 is also designed to be vertically adjustable to tension the rolled product 2 that is clamped into the rolled product clamps 6, 8 in the elevated inspection position in the specific embodiment to allow uniform grinding of the upper surface of the rolled product 2. For this purpose, the tensioning station 10, which in the present embodiment is shaped like a stamp with a molded part 16 that is similar in appearance to a stamp pad, presses upward against the underside of the rolled product 2 until a suitable grinding tension of the rolled product 2 is produced. The upper side of the rolled product 2, which is detached from the belt conveyor 4 and tensioned, can then be ground for inspection purposes without the surface appearance of the rolled product 2 being distorted or disturbed by the texture of the belt conveyor 4.

Figure 1E:
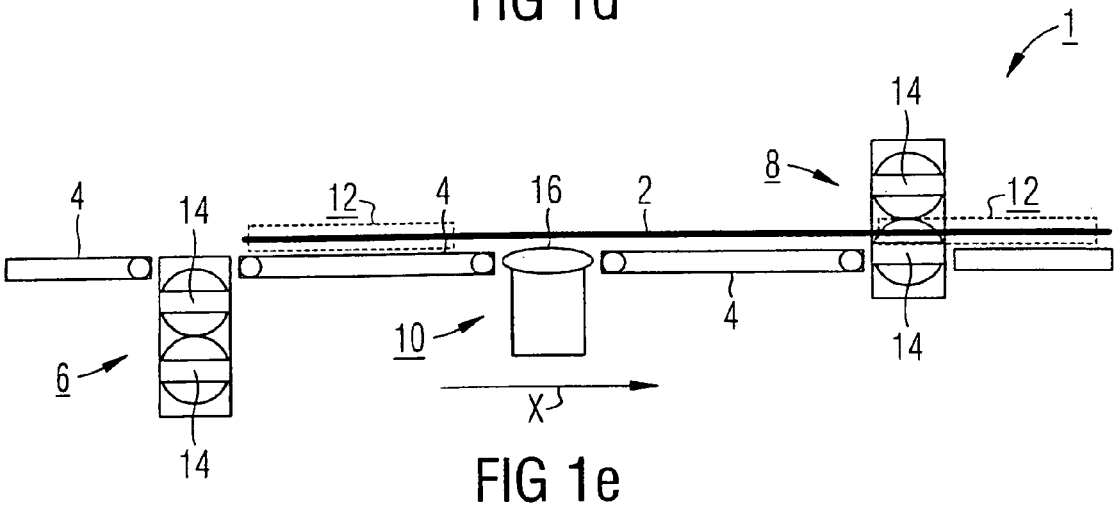
Figure 1F:
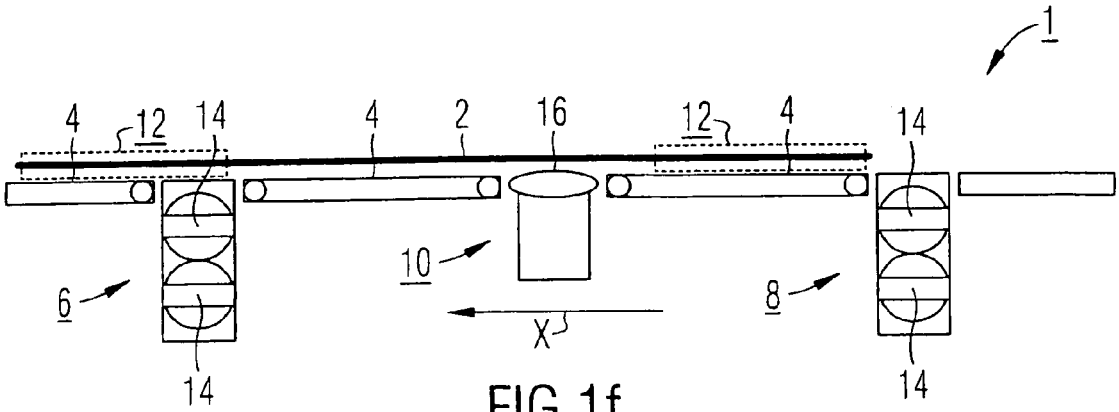

After the inspection has been performed, the tensioning station 10 is lowered back to the height of the initial position described in connection with FIG. 1*a*. During this lowering operation, the two rolled product clamps 6, 8 with the clamped rolled product 2 are first brought to the height of the intermediate position described in connection with FIG. 1*b*. The clamping mechanism of the rolled product clamps 6, 8 is then released, so that in this specific embodiment, their clamping jaws 14 release the inspected rolled product 2. In FIG. 1*e*, therefore, the clamping jaws 14 are no longer shown turned towards each other but rather parallel to each other. The rolled product 2 is then moved in the direction of conveyance X out of the first rolled product clamp 6 (first with respect to direction of conveyance X), and the now free rolled product clamp 6 is lowered back into its initial position. The drawing in FIG. 1*e* thus shows the tensioning station 10 and the rolled product clamp 6 below the belt conveyor 4. The rolled product 2 is then moved in the direction opposite the direction of conveyance X in this embodiment until the next rolled product clamp 8 (next with respect to the direction of conveyance X) is also cleared, and the now free rolled product clamp 8 is lowered into the initial position. Accordingly, the drawing in FIG. 1*f* shows the tensioning station 10 and the rolled product clamps 6 and 8 back below the belt conveyor 4.

For the subsequent use, for example, feeding to a turning device to allow the underside of the strip also to be inspected, the rolled product 2 is again moved in the direction of conveyance X in this embodiment until it again occupies its initial position, as shown in FIG. 1*a*.

Naturally, the rolled product 2 can also be moved out of the rolled product clamp 8 first, and then the rolled product clamp 8 can be lowered into the initial position before the rolled product clamp 6 is cleared and lowered. In this case, the signs of the direction of conveyance X of the rolled product 2 are to be changed accordingly.

LIST OF REFERENCE NUMBERS

1 inspection system
2 rolled product
4 belt conveyor
6 rolled product clamp
8 rolled product clamp
10 tensioning station
12 marginal areas
14 clamping jaws
16 molded part
X direction of conveyance

The invention claimed is:

1. Inspection system (1) for rolled products (2) of a rolling mill, comprising: a belt conveyor (4) for rolled products (2); a number of vertically adjustable rolled product clamps (6, 8) arranged along the belt conveyor (4) for fixedly holding the rolled products (2), whereby the product clamps, with upper and lower clamping jaws (14) holding the rolled products, are vertically movable as a unit to lift the rolled products off the belt conveyor; and a vertically adjustable tensioning station arranged between two rolled product clamps so as to only be directly contactable with a bottom surface of the rolled product, the clamps, the tensioning station and the fixedly held rolled products being movable vertically upward into an inspection position in which the clamps, the tensioning station and the fixedly held rolled products are maintained stationary during inspection.

* * * * *